US009336725B2

(12) United States Patent
Cho et al.

(10) Patent No.: US 9,336,725 B2
(45) Date of Patent: May 10, 2016

(54) ELECTRONIC DEVICE, DISPLAY CONTROLLING APPARATUS AND METHOD THEREOF

(71) Applicant: LG Display Co., Ltd., Seoul (KR)

(72) Inventors: Byoungchul Cho, Seoul (KR); Sangjae Park, Busan (KR)

(73) Assignee: LG Display Co., Ltd., Seoul (KR)

( * ) Notice: Subject to any disclaimer, the term of this patent is extended or adjusted under 35 U.S.C. 154(b) by 119 days.

(21) Appl. No.: 14/249,112

(22) Filed: Apr. 9, 2014

(65) Prior Publication Data

US 2014/0307007 A1 Oct. 16, 2014

(30) Foreign Application Priority Data

Apr. 11, 2013 (KR) ..... 10-2013-0040145

(51) Int. Cl.

*G09G 5/10* (2006.01)
*G09G 3/34* (2006.01)
*G09G 3/36* (2006.01)

(52) U.S. Cl.

CPC ..... *G09G 3/3406* (2013.01); *G09G 3/3648* (2013.01); *G09G 2320/064* (2013.01); *G09G 2320/0646* (2013.01); *G09G 2320/0666* (2013.01); *G09G 2360/144* (2013.01); *G09G 2360/16* (2013.01); *G09G 2380/14* (2013.01)

(58) Field of Classification Search

None

See application file for complete search history.

(56) References Cited

U.S. PATENT DOCUMENTS

2011/0057961 A1 3/2011 Tsuru et al.
2012/0019152 A1 1/2012 Barnhoefer et al.
2012/0127221 A1 5/2012 Tamaki et al.
2012/0206513 A1 8/2012 Ueno
2012/0212520 A1* 8/2012 Matsui ..... G09G 3/3611 345/690
2012/0221943 A1 8/2012 Yamada

FOREIGN PATENT DOCUMENTS

KR 10-2012-0023529 A 3/2012

OTHER PUBLICATIONS

PCT International Search Report for PCT/KR2014/003158, Aug. 4, 2014, 3 Pages.

* cited by examiner

*Primary Examiner* — Adam R Giesy
(74) *Attorney, Agent, or Firm* — Fenwick & West LLP

(57) ABSTRACT

There are provided an electronic device and a display controlling apparatus and method. The display controlling apparatus that is driven in a paper mode and includes a backlight includes an image processing device that first converts a gradation value of an input image so as to have image characteristics of the paper mode, and second converts the first converted gradation value of the input image so as to have a upper limit gradation value is scaled up to the maximum gradation value, and a backlight brightness determining unit that determines brightness of light irradiated by the backlight to be lowered in response to the second conversion of the gradation value.

21 Claims, 13 Drawing Sheets

FIG. 2B

| IMAGE CHARACTERISTIC / INPUT GRADATION | 110nit 22:1 3800k | 115nit 25:1 4000k | · · · · · |
|---|---|---|---|
| 0 | 3 | 8 | · · · · · |
| 1 | 4 | 8 | · · · · · |
| 2 | 5 | 9 | · · · · · |
| 3 | 7 | 11 | · · · · · |
| ⋮ | ⋮ | ⋮ | ⋮ |
| 255 | 240 | 248 | · · · · · |

FIG. 2C $$G_{max} = j\,(\text{LUMINANCE, C/R, COLOR TEMPERATURE}) \cdots \text{Equation 1}$$

$$G_{min} = i\,(\text{LUMINANCE, C/R, COLOR TEMPERATURE}) \cdots \text{Equation 2}$$

$$G_{out} = G_{min} + \frac{G_{max} - G_{min}}{2^n - 1} \times G_{min} \cdots \text{Equation 3}$$

ELECTRONIC DEVICE, DISPLAY CONTROLLING APPARATUS AND METHOD THEREOF

CROSS-REFERENCE TO RELATED APPLICATION

This application claims priority to and the benefit of Korean Patent Application No. 10-2013-0040145, filed on Apr. 11, 2013, the disclosure of which is incorporated herein by reference in its entirety.

BACKGROUND

1. Field of the Invention

The present disclosure relates to an electronic device and a display controlling apparatus and method, and more particularly, to an electronic device in which power consumption is reduced when driven in a variety of screen modes including a paper mode, and a display controlling apparatus and method.

2. Discussion of Related Art

With the recent increase of interest in information display and demands for portable electronic devices, research and commercialization of lightweight and thin-shaped flat display apparatuses have been widely conducted. In particular, a liquid crystal display (LCD) among the flat display apparatuses has unique image characteristics such as brightness value, contrast ratio, and a color gamut.

The LCD flat display apparatus provides a variety of screen modes so that a user may select a desired screen according to the user's preference.

The screen modes include, for example, a standard mode, a dynamic mode, a natural mode, a cinema mode, and the like, and in each of the screen modes, an input image is converted so as to have desired image characteristics in terms of maximum brightness value, color temperature and contrast ratio.

The power consumption in the LCD is determined roughly by backlight driving power and panel driving power. The backlight driving power is determined in accordance with brightness of the backlight. Reducing the brightness of the backlight lowers the backlight driving power, which reduces the power consumption of the LCD. However, adjusting the brightness of the backlight directly affects image characteristics of the LCD. Thus, when the backlight of the LCD is reduced, there were difficulties to maintain the same image.

SUMMARY OF THE INVENTION

The recent display has been highly utilized in eBooks or electronic devices for displaying texts. When the LCD is utilized in an eBook, a screen mode for imitating paper is demanded by users. Paper mode is a screen mode for imitating the image characteristics of an actual paper. The image characteristics of the paper mode are different from the image characteristics of the conventional screen modes.

An image processing device first converts the image characteristics of the input image to apply the paper mode for providing paper-like feeling.

An image processing device second converts the first converted input image. The second converted input image maintains substantially the same image characteristics as the first converted input image. Meanwhile, the power consumption of the LCD after the second conversion is reduced compared to that after the first conversion.

In other words, the first conversion provides the image characteristics of the paper mode and the second conversion maintains substantially the same image characteristics of the paper mode while the power consumption of the LCD is reduced.

The present disclosure is directed to an electronic device that reduces power consumption while maintaining the same image characteristics of the paper mode without reducing brightness of an LCD when the backlight brightness of the LCD is adjusted and a display controlling apparatus and method.

In one embodiment, a display controlling apparatus is provided. The display controlling apparatus is driven in a paper mode and includes a backlight. The display controlling apparatus comprises, an image processing device first converting a gradation value of an input image so as to have image characteristics of the paper mode, and second converting the first converted gradation value of the input image so as to have a maximum gradation value, and a backlight brightness determining unit determining brightness of light irradiated by the backlight to be lowered in response to the second conversion of the gradation value.

In one embodiment, the image processing device first converting the gradation value of the input image by associating the gradation value of the input image with a lookup table.

In one embodiment, the first conversion of the gradation value of the input image includes applying a first upper limit gradation value and a first lower limit gradation value of the paper mode.

In one embodiment, the second conversion of the gradation value is performed by applying a scaling factor to the first converted gradation value of the input image.

In one embodiment, the scaling factor is a ratio of a second upper limit gradation value acquired from the first converted image and the maximum gradation value, and wherein the second upper limit gradation value is the highest gradation value in the first converted image.

In one embodiment, the backlight brightness determining unit determines to lower the brightness of the backlight by applying the scaling factor to the brightness of the backlight for the input image.

In one embodiment, the image characteristics of the paper mode include at least one of a color temperature, brightness, and a contrast ratio.

In one embodiment, the gradation value of the input image includes a gradation value of each of R, G, and B colors, and the first conversion for the gradation value of the input image and the second conversion for the first converted gradation value of the image are associated with each of gradation values of the R, G, and B colors.

In one embodiment, the image characteristics of the paper mode are image characteristics with respect to a plurality of different types of papers.

In one embodiment, the second conversion of the image processing device is implemented by histogram stretching.

In one embodiment, the backlight brightness determining unit determines the brightness of the backlight to be lowered in accordance with a degree to which the histogram stretching is performed.

In one embodiment, an electronic device is provided. The electronic device comprises a liquid crystal display panel displaying an image having image characteristics of a paper mode and a maximum gradation value, a backlight irradiating the liquid crystal display panel with light, an image processing device converting a gradation value of an input image to have the image characteristics of the paper mode and the maximum gradation value, and a backlight control unit controlling brightness of light irradiated by the backlight to be lowered in response to the gradation conversion of the input image to have the maximum gradation value.

In one embodiment, a method for displaying an image in a display apparatus including a backlight is provided. The method comprises first converting a gradation value of an input image to have image characteristics of a paper mode, second converting the first converted gradation value of the image to have a maximum gradation value, controlling brightness of the backlight in response to the second conversion, and displaying an image of the second converted gradation value.

In one embodiment, the first converting comprises associating the gradation value of the input image with a lookup table.

In one embodiment, the converting the gradation value of the input image to have the image characteristics of the paper mode includes applying a first upper limit gradation value and a first lower limit gradation value to the input image.

In one embodiment, the second converting comprises applying a scaling factor to the first converted gradation value of the image.

In one embodiment, the scaling factor is a ratio of a second upper limit gradation value of the first converted image and the maximum gradation value, and wherein the second upper limit gradation value is the highest gradation value in the first converted image.

In one embodiment, the controlling of the brightness of the backlight comprises lowering the brightness of the backlight by applying the scaling factor to the brightness of the backlight with respect to the input image.

In one embodiment, the gradation value of the input image includes a gradation value of each of R, G, and B colors, and the first converting and the second converting are associated with each of gradation values of the R, G, and B colors.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which:

FIG. 2B is a lookup table illustrating an example in which an image processing device of an electronic device according to one embodiment of the present disclosure;

FIG. 2C is equations illustrating an example in which an image processing device of an electronic device according to one embodiment of the present disclosure;

DETAILED DESCRIPTION OF EXEMPLARY EMBODIMENTS

Figure 1:
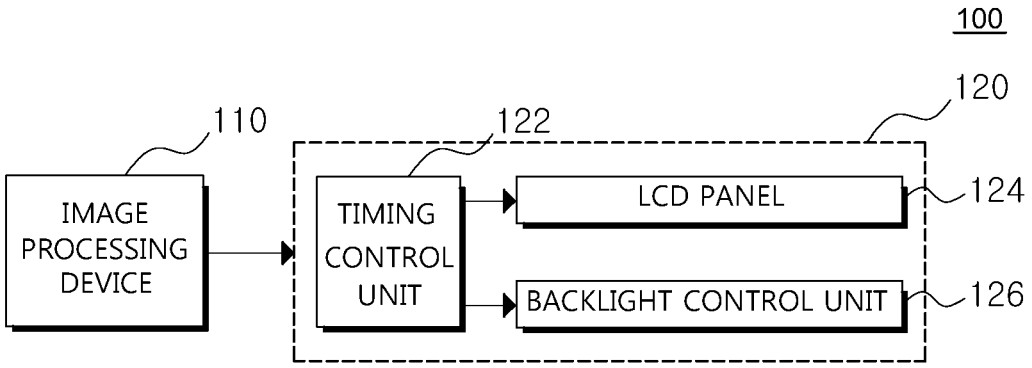
FIG. 1 is a block diagram illustrating an electronic device according to one embodiment of the present disclosure.

Exemplary embodiments of the present disclosure will be described in detail below with reference to the accompanying drawings. While the present disclosure is shown and described in connection with exemplary embodiments thereof, it will be apparent to those skilled in the art that various modifications can be made without departing from the spirit and scope of the disclosure.

In this specification, like numbers refer to like elements throughout the description of the drawings.

Although the terms first, second, etc. may be used to describe various elements, it should be understood that these elements are not limited by these terms. These terms are only used to distinguish one element from another. For example, a first element could be termed a second element, and, similarly, a second element could be termed a first element, without departing from the scope of exemplary embodiments.

In this specification, an image refers to a visual image, which includes all kinds of elements displayed on a screen or a display device. The image may include a moving image, a still image, a still cut image, etc. In this case, the moving image may be composed of a plurality of image frames, and each image frame may include a plurality of layers or regions. The image may be a two-dimensional image or a three-dimensional image. In this specification, since image processing is performed on both the images which are two-dimensional and three-dimensional images, both the two-dimensional and three-dimensional images are referred to as the images unless described otherwise.

In this specification, color information may be expressed as various color coordinates such as YUV, CMYK, HSV, and RGB, which are characteristics of colors of incident light or a screen to be displayed. In this specification, however, the color information which is assumed to be RGB color coordinates will be described for the sake of convenience of description. Also, each of the color coordinates may be optionally converted from RGB to HSV or from HSV to RGB in consideration of a use purpose and the number of arithmetic operation.

Also, a part of a module, a segment, or a code including one or more practicable instructions for executing a certain logical function(s) may be shown in each of the blocks or the operations.

In this specification, it should also be noted that the functions described in each of the blocks or the operations may be exhibited out of sequence. For example, two blocks or operations shown in sequence may be executed substantially at the same time.

Respective features of various embodiments of the present disclosure may be partially or wholly combined with each other, and a variety of linkages and driving may be made possible in the technical manner as those skilled in the art can fully understand. The embodiments may be performed independently from each other or performed in association with each other. Hereinafter, the present disclosure will be described in detail with reference to the accompanying drawings.

FIG. 1 is a block diagram illustrating an electronic device according to one embodiment of the present disclosure.

An electronic device 100 includes an image processing device 110 and a display apparatus 120. The electronic device 100 displays an image through the display apparatus 120. The image characteristics of the image to be displayed on the display apparatus 120 may be determined by a plurality of screen modes including a paper mode. The screen mode may refer to a display mode, an image quality mode, or the like. The screen mode may include, for example, a clear mode, a standard mode, a natural mode, a cinema mode, a paper mode, an automatic adjustment mode, an outdoor mode, a low power mode, and the like.

The conversion to apply a screen mode includes conversion of the image characteristics of an input image. The converted input image has a specific color temperature, maximum brightness value, contrast ratio, a color gamut, and the like in accordance with the applied screen mode. The term "maximum brightness value" may refer to the maximum luminance (nits) of the display device when the gradation value of the input image is maximum value.

The paper mode may be a screen mode that imitates image characteristics of an actual paper or a printed matter under an ambient environment. The image characteristics of a paper may include maximum brightness value, a color temperature, contrast ratio, and a color gamut. The image characteristics of paper further include at least one of reflectance (%), transmittance (%), opacity (%), whiteness, surface texturing, and the like of paper surface.

In addition, the paper mode may be a screen mode for eBooks contents. The paper mode provides feelings such as reading a print on actual paper. In the paper mode, a variety of paper materials may be further selected so as to reflect characteristics of paper. For example, surface reflectance of a paper in terms of visual wavelength, surface texture information, transmittance characteristics which are obtained by analyzing physical characteristics of creamy vellum paper, copy paper, newsprint, traditional Korean paper, oil paper, and the like may be applied to the paper mode.

In addition, the paper mode may further reflect ambient light information. For example, the amount of the ambient light is reflected to the paper mode by using ambient light information received by at least one of a color sensor, a color temperature sensor, a proximity sensor, an image sensor, a camera, an illuminance sensor, a GPS module, application information, a digital clock, and the like, and textures of a variety of types of paper.

The image characteristics of different types of actual papers can be determined according to various known test methods, for example there are Korean Industrial Standards "KS M 7038, testing method for opacity of paper," "KS M ISO 11475, paper and board-determination of CIE whiteness, D65/10 degrees (outdoor daylight))," "KS M ISO 11476, paper and board-determination of CIE whiteness, C/2 degrees (indoor illumination conditions))," and International Organization for Standardization (ISO) corresponding to the above-described measurement method.

An electronic device 100 may store the image characteristics of different types of actual papers.

Figure 7:
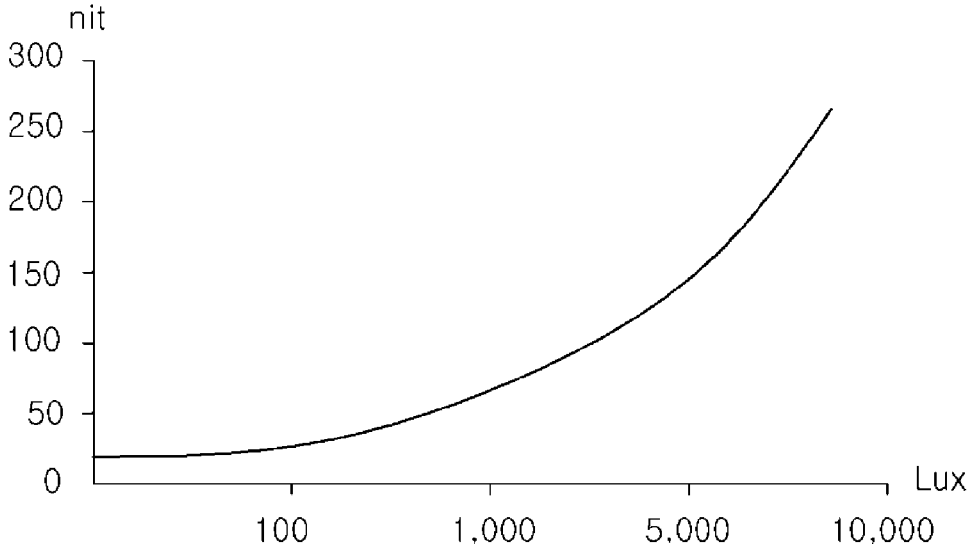
FIG. 7 illustrates target luminance based on illumination of ambient light in the paper mode when reflectance of paper is 80% as an example.

An electronic device 100 may receive ambient light information to determine one of the image characteristics of the paper mode. FIG. 7 shows target luminance based on illumination of ambient light in the paper mode when reflectance of paper is 80% as an example. The target brightness value is the maximum brightness value of the converted input image to be displayed on the display apparatus 120, and the target brightness value is determined by the illumination (lux) level of the ambient light. Referring to FIG. 7, an x-coordinate indicates the illumination level of the ambient light, and a y-coordinate indicates maximum brightness value of the converted input image to be displayed on the display apparatus 120.

The paper mode also has an offset brightness value regardless of the illumination of the ambient light. The offset is provided for a user's visibility when the illumination level of the ambient light is too low to perceive the image displayed on the display apparatus 120. For example in FIG. 7, when the illumination of the ambient light is 0 lux, the lower limit brightness value is 18 nits, not 0 nits.

Figure 8:
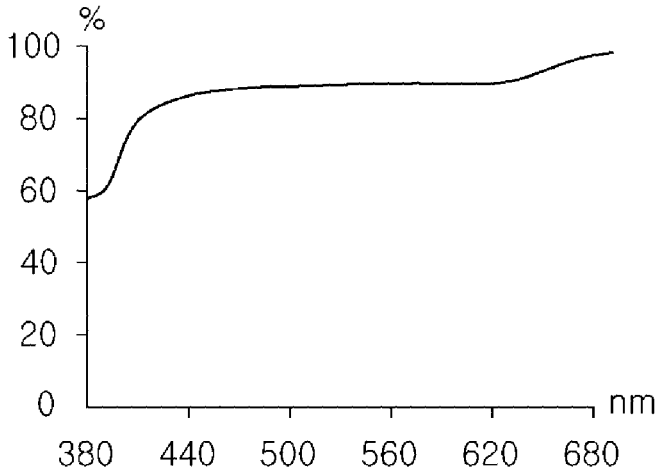
FIG. 8 illustrates reflectance by wavelength of paper.

An electronic device 100 may determine one of the image characteristics of the paper mode such as color temperature. The color temperature can be determined based on reflectance of a paper and illumination of ambient light. For example, referring to the FIG. 8, an x-coordinate indicates a wavelength (nm) of visible light, and a y-coordinate indicates reflectance (%) of a paper. Reflectance by wavelength of the paper is rapidly reduced at or below 440 nm. Consequently, this kind of paper absorbs blue color wavelength which is around 380 nm more than red color wavelength which is around 680 nm. Therefore, the paper will looks reddish white. In general, higher color temperature looks bluish white and lower color temperature looks reddish white. Therefore, when a certain type of paper is selected, the color temperature can be determined.

In this example, the determined color temperature is 3000K to 5000K. On the other hand, the standards color temperature of LCD or OLED are higher in general.

In addition, when the electronic device 100 acquires the illumination level of ambient light of 1150 lux, and color temperature of the ambient light of 4500 K, the image processing device 110 may convert the input image to apply the paper mode based on the acquired ambient light information.

For example, when the image characteristics of the electronic device 100 is set to show the input image in maximum brightness value of 400 nits, contrast ratio of 300:1 and color temperature of 7800 K, the input image can be converted such that the converted input image is shown in maximum brightness value of 110 nits, contrast ratio of 30:1 and color temperature of 3800 K, in response to the paper mode. The converted input image may provide paper-like feeling. The converted input image has lower maximum brightness value, lower contrast ratio, lower color temperature than the original input image.

The image processing device 110 converts the input image in response to a selected screen mode. Hereinafter, in the specification, it is assumed that the selected screen mode is the paper mode unless the selected screen mode is specified.

The input image has a plurality of pixels and each pixel has a gradation value. A gradation value for each pixel represents the brightness value of the corresponding pixel of the display apparatus 120. For example, the 255th gradation value in case of 8 bits of input image represents 400 nits of brightness value for corresponding pixel of the display apparatus 120 when the display apparatus is capable of emitting up to 400 nits. The 0th gradation value in case of 8-bit of input image represents 0 nits of brightness value for corresponding pixel of the display apparatus 120.

The pixels of the input image includes an n-bit digital image corresponding to each of red, green and blue, that is, a digital image representing gradation values between 0 to 2n−1. For example, a 24-bit input image of which red, green and blue respectively have an 8-bit gradation may represent 16,777,216 colors.

It should be noted that depending on the type of display apparatus 120, the brightness value may vary even though the gradation values are the same for each display apparatus 120.

The image processing device 110 may receive an input image from an external device, an external memory, and a wired/wireless receiving device. The image processing device 110 may perform signal processes such as decoding, noise removal, contrast adjustment, image scaling, and the like, and may perform signal processes with respect to each of a left image and a right image when the input image is a three-dimensional (3D) image.

Referring to FIG. 1, the display apparatus 120 includes a timing control unit 122, an LCD panel 124, and a backlight control unit 126. The timing control unit 122 of the display apparatus 120 receives a converted input image from the image processing device 110 and controls brightness of the backlight based on the converted input image from the image processing device 110. The timing control unit 122 controls the LCD panel 124 to display the converted input image. The timing control unit 122 controls the backlight control unit 126 to adjust the brightness of the backlight. The display apparatus 120 may refer to a display unit or the like. The electronic device 100 according to one embodiment of the present disclosure can be variety types of display apparatuses 120.

The display apparatus 120 may be a liquid crystal display apparatus. The liquid crystal display apparatus may include a lower substrate, an upper substrate, a pixel electrode, a common electrode, a color filter, a polarization film, and a liquid crystal layer interposed between the upper substrate and the lower substrate.

The liquid crystal display apparatus controls liquid crystal by an electric field formed between the pixel electrode and the common electrode and selectively transmits light entering from a separate light source transmitted through the polarization film in accordance with the degree to which the liquid crystal is controlled. The selectively transmitted light passes through the color filter positioned on the upper substrate so that an image is displayed.

The liquid crystal display apparatus may be driven as a display apparatus in such a manner that a light source is formed on a side surface of the liquid crystal display apparatus different from a rear surface thereof. The liquid crystal display apparatus may be driven by a passive matrix and an active matrix.

Figure 2A:
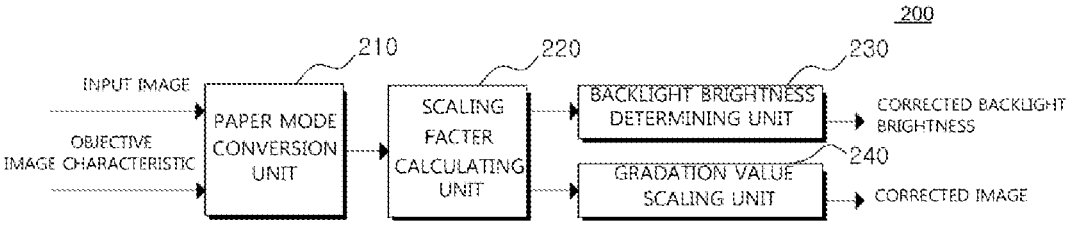
FIG. 2A is a block diagram illustrating an image processing device according to one embodiment of the present disclosure.

FIG. 2A is a block diagram illustrating an image processing device 200 according to one embodiment of the present disclosure.

The image processing device 200 includes a paper mode conversion unit 210, a scaling factor calculating unit 220, a backlight brightness determining unit 230, and an gradation value scaling unit 240.

In FIG. 2A, for convenience of description, an example in which a plurality of modules are included in the image processing device 200 is illustrated, but a variety of functions of the image processing device 200 which will be described below may be implemented in the form of being executed in a single module.

The image processing device 200 is configured to receive an input image. The image processing device 200 is configured to process a first conversion in response to a selected screen mode. The first conversion converts the input image to have the image characteristics of the selected screen mode.

The image processing device 200 is configured to process a second conversion after the first conversion is processed. The second conversion converts the converted input image by the first conversion.

During the second conversion, the second upper limit gradation value of the first converted input image is detected. The term "second upper limit gradation value" refers to the highest gradation value among a plurality of pixels of the first converted image. During the second conversion, the second upper limit gradation value of the first converted input image is scaled up to the maximum gradation value.

The term "maximum gradation value" refers to the possible maximum gradation value of the input image. For example, in case of 8-bit of input image, the maximum gradation value is 255th gradation value.

Hereunder for convenience, the term "the first converted image" refers to the input image which is converted to have the image characteristics of the selected screen mode. In other words, the first converted image is the output of the first conversion. The term "the second converted image" refers to the first converted image which its upper limit gradation value is scaled up to the maximum gradation value. In other words, the second converted image is the output of the second conversion.

The image processing device 200 is configured to provide the second converted image to the display apparatus.

When a selected screen mode is applied to the input image, the gradation value of the each pixel of the input image is converted in accordance with image characteristics of the selected screen mode.

In the first converted image, only a partial gradation range within the gradation range of the input image is selected and used for realizing the image characteristics of the selected screen mode. To define a partial gradation range, a first lower limit gradation value and a first upper limit gradation value are determined.

That is, after applying the first lower limit gradation value and the first upper limit gradation value, the partial gradation range may be within the gradation range smaller than 0th to (2n−1)th. For example, the gradation range of the input image before the conversion is 0th to 255th, and the gradation range of the first converted image may be 22nd to 250th. The first converted image may have independent gradation ranges for red, green and blue. In other words, the first lower limit gradation values and the first upper limit gradation values for red, green and blue are independently set to realize the image characteristics of the selected screen mode.

The image processing device 200 determines brightness of the backlight in response to the second conversion. Since the brightness of the backlight has a high proportion in the power consumption of the liquid crystal device, lowering the brightness of the backlight is an important factor for reducing the power consumption.

The sequence of the first conversion and the second conversion may be flipped. Regardless of the sequence, the image characteristics of the paper made are the substantially the same for both sequences. However, in terms of the power consumption, the power efficiency becomes different. For example, it has better power efficiency of the display apparatus 120 when the first conversion is processed before the second conversion is processed.

The power efficiency difference is cause by the power consumption of the backlight. When the first conversion is processed before the second conversion is processed, the brightness of the backlight can be minimized but the brightness of the display apparatus remains the same. The power efficiency will be disclosed in details hereinafter.

The paper mode conversion unit 210 of the image processing device 200 is configured to receive an input image and the image characteristics of the selected screen mode. The paper mode conversion unit 210 converts the input image so as to achieve the image characteristics of the selected screen mode. In other words, the paper mode conversion unit 210 is configured to process the first conversion.

The scaling factor calculating unit 220 is configured to calculate a scaling factor. The term "scaling factor" refers to the scaling factor for the second conversion in which maintains the substantially the same image characteristics of the first conversion but the second upper limit gradation value of the first converted image to be the maximum gradation value. The scaling factor is used to second convert the first converted image during the operation of the gradation value scaling unit 240. The scaling factor is used to adjust the brightness of the backlight during the operation in the backlight brightness determining unit 230.

The scaling factor calculating unit 220 is configured to acquire a second upper limit gradation value of the first converted image to calculate the scaling factor.

The scaling factor calculating unit 220 is configured to calculate the scaling factor by dividing the maximum gradation value by the second upper limit gradation value. The scaling factor may be represented by the following equation.

$$\text{Scaling factor} = \frac{\text{maximum gradation value}}{\text{second upper limit gradation value}}$$

The scaling factor calculating unit 220 is configured to output the scaling factor to the backlight brightness determining unit 230 and the gradation value scaling unit 240, respectively.

The gradation value scaling unit 240 is configured to receive the scaling factor from the scaling factor calculating unit 220 and convert the first converted image by multiplying the red, green and blue colors value of the first converted image by the scaling factor.

When the red, green and blue value of the first converted image is multiplied by the scaling factor, the first converted image may be converted to have a second upper limit gradation value as the maximum gradation value. In other words, the gradation value scaling unit 240 is configured to process the second conversion.

For example, when the second upper limit gradation value of the first converted image is 200th in case of an 8-bit input image, the second upper limit gradation value is converted to have the maximum gradation value by multiplying the scaling factor. In this example, the scaling factor is 1.275 and the second upper limit gradation value of the second converted image is converted to 255th. The backlight brightness determining unit 230 adjusts a standard backlight brightness value based on the scaling factor. The backlight brightness determining unit 230 may divide the standard backlight brightness value by the scaling factor, and the divided value may be determined as the backlight brightness value.

When dividing the default backlight brightness value by the scaling factor, the adjusted brightness of the backlight may be reduced in response to the gradation value of the second converted image.

The brightness value of the display apparatus recognized by the user is substantially the same as that after the first conversion. The only difference is that the backlight brightness is reduced.

The image processing device 200 may minimize power consumption by adjusting the backlight while maintaining the brightness of the display apparatus when applying the paper mode.

FIG. 2B is a lookup table illustrating an example in which an image processing device of an electronic device according to one embodiment of the present disclosure.

Referring to FIG. 2B, the corresponding image may have a gradation value of 2n. Hereinafter, for convenience of description, an input image and a converted image have 0th to 255th gradation values, but the image is not limited thereto and may have the gradation value of 2n (n being a natural number).

Each row of FIG. 2B may indicate a gradation value of the converted image corresponding to gradation of the input image, and each column may indicate converted values with respect to a plurality of image characteristics. The determined a plurality of image characteristics of FIG. 2B includes a brightness, a contrast ratio (C/R), and a color temperature, but is not limited thereto and may include a variety of image characteristics.

A lookup table defining converted values with respect to a specific image characteristics corresponding to the gradation value of the input image may be stored in, for example, a memory. The image processing device may use a lookup table for converting the input image in accordance with a plurality of image characteristics. The paper mode conversion unit of the image processing device is configured to convert the input image by associating the input image with the lookup table in accordance with the determined image characteristics. Referring to FIG. 2B, input values 0, 1, 2, 3, . . . 255 may be converted into 3, 4, 5, 7, and 240 so that the input image has a 110-nit brightness, 22:1 C/R, and a color temperature of 3800 k in the paper mode. Although not shown in FIG. 2B, conversion of the gradation values in order to achieve the image characteristics may be performed with respect to each of red, green and blue colors.

FIG. 2C shows equations illustrating an example in which an image processing device of an electronic device according to one embodiment of the present disclosure.

An equation for converting the input image may be defined using each of the image characteristics as a variable.

A first upper limit gradation value of red (Rmax), a first upper limit gradation value of green (Gmax), and a first upper limit gradation value of blue (Bmax) for realizing full white of the applied image characteristics. A first lower limit gradation value of red (Rmin), a first lower gradation value of green (Gmin), and a first lower gradation value of blue (Bmin) for realizing full black of the applied image characteristics.

The determined color temperature and C/R of the image characteristics can be realized at the display apparatus by applying the first upper limit gradation value and the first lower limit gradation value to each of the red, green and blue colors of the input image.

Referring to FIG. 2C, Equation 1 for determining Gmax using the brightness, C/R, and the color temperature which are the determined image characteristics as variables and Equation 2 for determining Gmin are illustrated.

Equation 3 for converting a gradation value of a green color pixel of the input image (Gin) into a converted gradation (Gout) using Gmax and Gmin is illustrated.

The image processing device may obtain Gout by substituting the gradation of the input image in Equation 3 including Gmin and Gmax values. The image processing device may convert the input image using only the first upper limit gradation value and the first lower limit gradation value of each of red, green and blue colors so that the paper mode is applied to the input image.

More specifically, Equations 4, 5, and 6 may indicate equations for calculating the converted red, green and blue gradation value using the first upper limit gradation value and the first lower limit gradation value.

$$R_{output} = R_{offset} + K_R * R_{input} \text{ where, } R_{offset} = R_{min} \cdot K_R = \frac{R_{max} - R_{min}}{2^n - 1} \quad \text{Eqn 4}$$

$$G_{output} = G_{offset} + K_G * G_{input} \text{ where, } G_{offset} = G_{min} \cdot K_G = \frac{G_{max} - G_{min}}{2^n - 1} \quad \text{Eqn 5}$$

$$B_{output} = B_{offset} + K_B * B_{input} \text{ where, } B_{offset} = R_{min} \cdot K_B = \frac{B_{max} - B_{min}}{2^n - 1} \quad \text{Eqn 6}$$

The red, green and blue gradation values of the input image are Rinput, Ginput, and Binput. Rmin, Gmin, and Bmin are the first lower limit gradation values of red, green and blue colors determined from image characteristics. Rmax, Gmax, Bmax are the first upper limit gradation values of the red, green and blue colors determined from image characteristics. Routput, Goutput, and Boutput are the red, green, and blue gradation values of the converted image calculated from Equations 4, 5, and 6.

Routput, Goutput, and Boutput have an offset value and a K weighted value. The weighted value of each of the red, green and blue colors may differ in accordance with a first upper limit gradation value and a first lower limit gradation value of each of the red, green, and blue.

The first upper limit gradation value may be set in accordance with a color temperature of the image characteristics. The first lower limit gradation value may be set in accordance with C/R of the image characteristics.

For example, when the determined image characteristics are a 100 nit-brightness, 50:1 C/R, and a color temperature of 5000 k. In this example, the first upper limit gradation value of the red, green and blue colors of the determined image characteristics is [245, 250, 230] (based on 8 bit input image), and the first lower limit gradation value of the red, green and blue colors of the determined image characteristics is [45, 51, 52].

Using Equations 4, 5, and 6, only the first upper limit gradation value and the first lower limit gradation value of the red, green and blue colors are determined. An image process may be performed with respect to the input image so that the paper mode is applied to the input image.

That is, when only the first upper limit gradation value and first lower limit gradation value of the red, green and blue colors are determined, values between the first upper limit gradation value and first lower limit gradation value can be calculated through Equations 4, 5, and 6.

The first upper limit gradation value and first lower limit gradation value of red, green and blue may be determined by the image processing device, or determined at the time of manufacturing.

Since a configuration of converting the input image using Equations 4, 5, and 6 may be obtained only by determining the first upper limit gradation value and first lower limit gradation value of red, green and blue, resources used for processing the input image may be converted by applying an alternative equation.

Meanwhile, when conversion of the input image is implemented by hardware, the following Equations 7, 8, and 9 may be used.

$$R_{output} = R_{min} + \frac{R_{max} - R_{min}}{2^n} \times (R_{input} + 1) \quad \text{Eqn (7)}$$

$$G_{output} = G_{min} + \frac{G_{max} - G_{min}}{2^n} \times (G_{input} + 1) \quad \text{Eqn (8)}$$

$$B_{output} = B_{min} + \frac{B_{max} - B_{min}}{2^n} \times (B_{input} + 1) \quad \text{Eqn (9)}$$

When the conversion of the input image is implemented by hardware using Equations 7, 8, and 9, red, green and blue may be obtained through a shift operation without including a pipeline divider, thereby significantly reducing the processing resources.

Figure 2D:
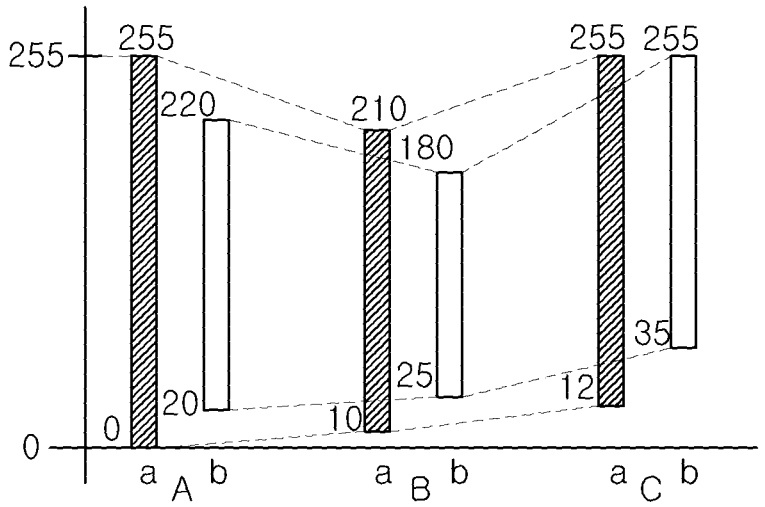
FIG. 2D is a graph illustrating an image processing result according to one embodiment of the present disclosure.

FIG. 2D is a graph illustrating an image processing result according to one embodiment of the present disclosure. An x-axis indicates an image of each of the image processing steps, and a y-axis indicates a gradation range. An 8-bit gradation is illustrated as an example.

The 'A' on the x-axis indicates two different input images 'a' and 'b' before the first conversion.

The 'a' of 'A' has the gradation values between 255th and 0th.

The 'b' of 'A' has the gradation values between 220th and 20th.

The image processing device may convert the input image 'a' and 'b' of 'A' so that the first conversion is processed to apply the paper mode.

The 'B' on the x-axis indicates two different first converted images by the first conversion. The first converted images 'a' and 'b' of 'B' have a limited gradation range compared to the two different input images of 'A'.

The first converted image 'a' of 'B' has first lower limit gradation value is 10th and first upper limit gradation value is 210th.

The first converted image 'b' of 'B' has first lower limit gradation value is 25th and first upper limit gradation value is 180th.

In case of the 'a' image of 'B', the input image is converted by the first conversion. The gradation value 255th is converted into 210th. Therefore there is no pixel having the gradation value higher than the 210th within the first converted image.

In case of the 'b' image of 'B', the input image is converted by the first conversion. The gradation value 220th is converted into 180th. Therefore there is no pixel having the gradation value higher than the 180th within the first converted image.

The image processing device may convert the input image 'a' and 'b' of 'B' so that the second conversion is processed to reduce the power consumption of the display apparatus.

The 'C' on the x-axis indicates two different second converted images by the second conversion. The second converted images 'a' and 'b' of 'C' have a limited gradation range but increased gradation range compared to the two different first converted images of 'B'.

The image processing device may convert the first converted images of 'B' based on a scaling factor. The second converted images 'a' and 'b' of 'C' have a gradation value of 255th.

The second converted image 'a' of 'C' has gradation values in range of 12th and 255th.

The second converted image 'b' of 'C' has gradation values in range of 35th and 255th.

When the first converted image is converted based on the scaling factor, the second upper limit gradation value becomes the maximum gradation value.

The scaling factor in the image 'a' of 'C' is 255/210, about 1.2. The image 'a' of 'C' is converted to have gradation value range between 12th and 255th by multiplying 10th and 210th of the image 'a' of 'B' by the scaling factor.

The scaling factor in the image 'b' of 'C' is 255/180, about 1.4. The image 'b' of 'C' is converted to have gradation value range between 35th and 255th by multiplying 25th and 180th of the image 'b' of 'B' by the scaling factor.

When the second conversion is processed, the second converted image has the maximum gradation value.

That is, when the second converted image has the maximum gradation value, a liquid crystal display apparatus can always have the maximum transmittance for at least one pixel of the second converted image.

When the maximum transmittance of the liquid crystal display apparatus is accomplished, optimized power consumption may be accomplished by maximally reducing the brightness of the backlight unit.

Hereinafter, adjustment of brightness of the backlight in response to second conversion from 'B' to 'C' will be described with reference to FIG. 2E.

Figure 2E:
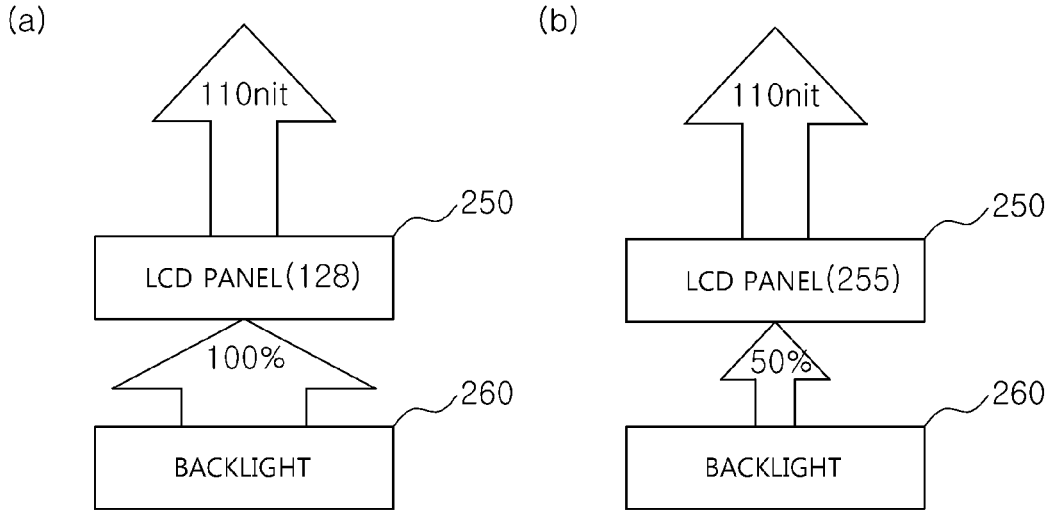
FIG. 2E is a conceptual diagram illustrating a liquid crystal display (LCD) according to one embodiment of the present disclosure.

FIG. 2E is a conceptual diagram illustrating a liquid crystal display (LCD) according to one embodiment of the present disclosure.

The image display apparatus includes an LCD panel 250 and a backlight 260.

In (a) of FIG. 2E, a liquid crystal display apparatus for displaying the first converted image is illustrated.

Referring to (a) of FIG. 2E, the backlight 260 emits light of 100% to the LCD panel 250. The LCD panel 250 has a highest gradation value of 128th, and transmits light with a brightness of 110 nits.

The LCD panel 250 may display an image by adjusting, by the backlight 260, the degree to which emitting light is transmitted. When a maximum gradation value is input to the LCD panel 250, the LCD panel 250 may transmit as much light as possible. In contrast, when a minimum gradation value is input to the LCD panel 250, the LCD panel 250 may shield as much light as possible or transmit as little light as possible.

The first converted image does not have the maximum gradation value, and therefore the LCD panel 250 cannot transmit light of 100%.

In (b) of FIG. 2E, a liquid crystal display apparatus for displaying the second converted image is illustrated.

Referring to (b) of FIG. 2E, the second converted image has image characteristics of the paper mode, and the backlight 260 emits light of 50% to the LCD panel 250. The second conversion scales up the gradation value to increase the transmittance of the LCD panel 250 to the maximum, and reduce the brightness of the backlight 260 correspond to the second conversion.

Compared to a case when the sequence of the first conversion and the second conversion is reversed, the power consumption efficiency is reduced. This is because the second conversion performs the scaling for improving the power efficiency. However, if the second conversion is processed before the first conversion, then the input image is scaled up then the scaled input image is converted to have the image characteristics of the paper mode. In this case, the highest gradation value of the final converted image cannot have the maximum gradation value.

Figure 2F:
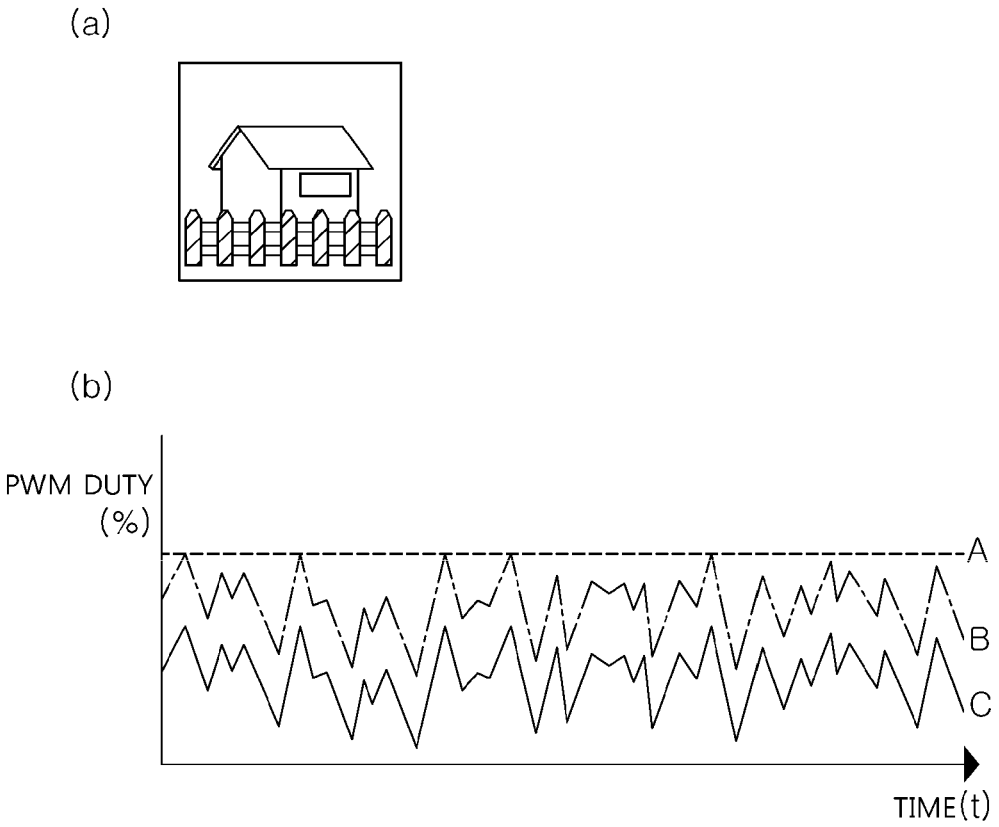
FIG. 2F is a test image and a pulse width modulation (PWM) duty graph for measuring a reduction in power consumption of an electronic device according to one embodiment of the present disclosure.

In (a) of FIG. 2F, a test image for measuring power consumption reduction of the electronic device according to one embodiment of the present disclosure is illustrated.

Example 1

A test image is processed by the first conversion and the second conversion in sequence to have a maximum brightness of 110 nits and a color temperature of 4300 k. Brightness of the backlight was adjusted to correspond to the second conversion, and then the second converted image was displayed on a liquid crystal display apparatus. Next, power consumption of the backlight was measured.

Comparative Example 1

A test image was displayed on the liquid crystal display apparatus without first conversion and the second conversion.

Comparative Example 2

A test image is processed by the first conversion to have a maximum brightness of 110 nits and a color temperature of 4300 k, and the first converted image was displayed on the liquid crystal display apparatus.

Comparative Example 3

A test image is processed by the second conversion and the first conversion in sequence to have maximum brightness of 110 nits and a color temperature of 4300 k The maximum brightness, the color temperature, and the power consumption of the backlight in each of Example and Comparative Examples are summarized in the following Table 1.

TABLE 1

| | Example 1 | Comparative Example 1 | Comparative Example 2 | Comparative Example 3 |
|---|---|---|---|---|
| Maximum brightness | 111 nit | 272 nit | 112 nit | 110 nit |
| Color temperature | 4308 k | 7258 k | 4328 k | 4311 k |
| Power consumption of backlight | 1.98 W | 4.08 W | 4.01 W | 3.85 W |

Referring to Table 1, in Example 1, it can be found that the maximum brightness is reduced and at the same time the power consumption of the backlight is reduced, compared to Comparative Example 1.

In (b) of FIG. 2F, a PWM duty graph for describing an image processing result of the electronic device according to one embodiment of the present disclosure is illustrated. An x-axis indicates time, and a y-axis indicates a PWM control duty ratio.

A line 'A' indicates a PWM control duty ratio in which only the first conversion is applied.

A line 'B' indicates a PWM control duty ratio in which the second conversion is applied and a PWM control duty ratio is adjusted to correspond to the second conversion and then the first conversion is applied.

A line 'C' indicates a PWM control duty ratio in which the first conversion is applied then the second conversion is applied and the brightness of the backlight is adjusted to correspond to the second conversion.

Referring to the line 'A', the PWM control duty ratio is not changed, and the duty ratio of 100% is maintained therefore there is no change in the power consumption.

Referring to the line 'B', the PWM control duty ratio is varied in accordance with the scaling factor. A change in the gradation in accordance with the image characteristics of the paper mode may not affect the PWM control duty ratio.

Referring to the line 'C', the PWM control duty ratio is varied in accordance with the scaling factor. The first conversion and the second conversion can accomplish the maximum PWM duty ratio less than 100% all the time. Furthermore the maximum PWM duty ratio is accomplished around 5% to 60%.

Figure 3A:
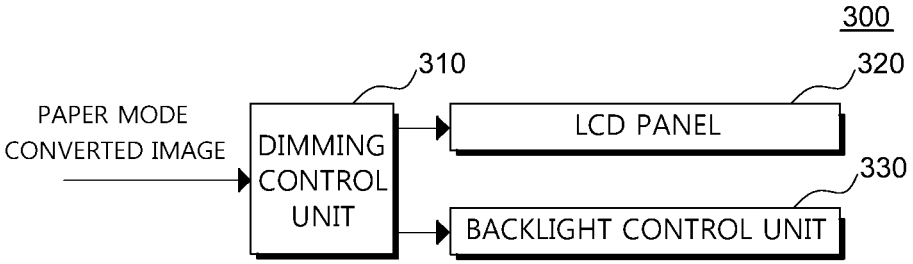
FIG. 3A is a block diagram illustrating an LCD according to one embodiment of the present disclosure.

FIG. 3A is a block diagram illustrating a liquid crystal display (LCD) according to one embodiment of the present disclosure.

The liquid crystal display apparatus 300 according to one embodiment of the present disclosure includes a dimming control unit 310, an LCD panel 320, and a backlight control unit 330.

The dimming control unit 310 may receive a first converted image. The dimming control unit 310 performs backlight dimming control with respect to the first converted image.

The dimming control unit 310 may process the second conversion through histogram analysis, and control the brightness of the backlight in accordance with the histogram analysis.

The dimming control unit 310 may also perform a function of a timing control unit of the liquid crystal display apparatus 300. The dimming control unit 310 may generate data control signals and scan control signals.

The backlight control unit 330 may receive a brightness of the backlight from the dimming control unit 310.

The backlight control unit 330 may change brightness of the backlight by adjusting a duty ratio in accordance with the input brightness value of the backlight. The backlight control unit 330 may emit the backlight with the changed brightness, FIG. 3B is a block diagram illustrating a dimming control unit of an LCD according to one embodiment of the present disclosure.

Figure 3B:
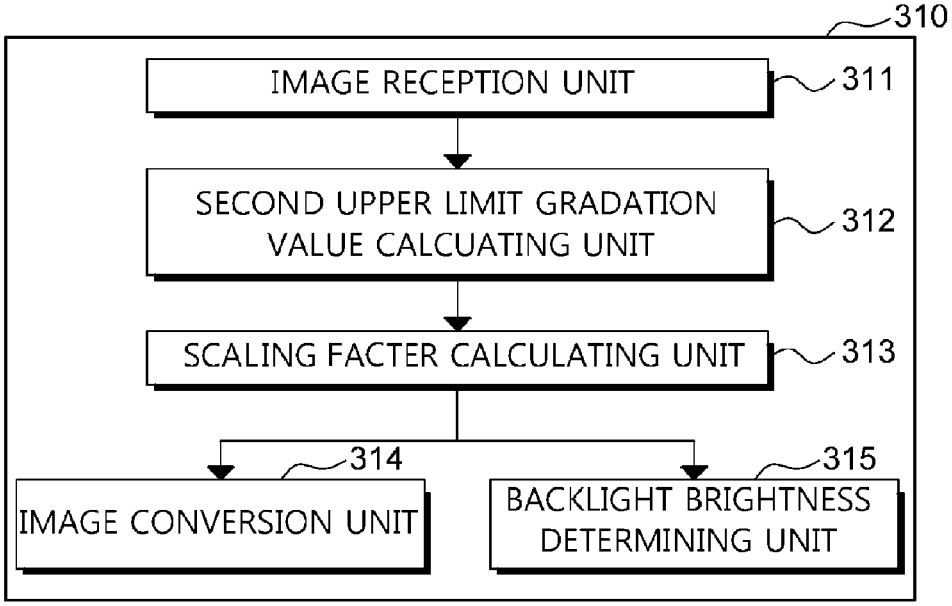
FIG. 3B is a block diagram illustrating a dimming control unit of an LCD according to one embodiment of the present disclosure.

Referring to FIG. 3B, the dimming control unit 310 includes an image reception unit 311, a second upper limit gradation calculating unit 312, a scaling factor calculating unit 313, an image conversion unit 314, and a backlight brightness determining unit 315. The dimming control unit 310 in FIG. 3B shows a method of performing dimming using the maximum value described in FIG. 3A.

The image reception unit 311 may receive an input image. The second upper limit gradation value calculating unit 312 may acquire a value of a second upper limit gradation value from the input image. The second upper limit gradation value calculating unit 312 may acquire a histogram of the input image, and acquire a highest gradation value from the first converted image by analyzing the histogram.

The scaling factor calculating unit 313 may calculate a scaling factor by dividing a maximum gradation value by the second upper limit gradation value. The scaling factor calculating unit 313 may output the calculated scaling factor to the image conversion unit 314 and the backlight brightness determining unit 315.

The image conversion unit 314 may process the second conversion after the first conversion by multiplying the scaling factor to the each pixel of the first converted image. The image conversion unit 314 may output the second converted image to the LCD panel.

The backlight control unit may determine brightness of the backlight by dividing the brightness of the backlight selected or set by a user by the calculated scaling factor. The backlight control unit may output the determined brightness of the backlight to the backlight control unit.

Figure 3C:
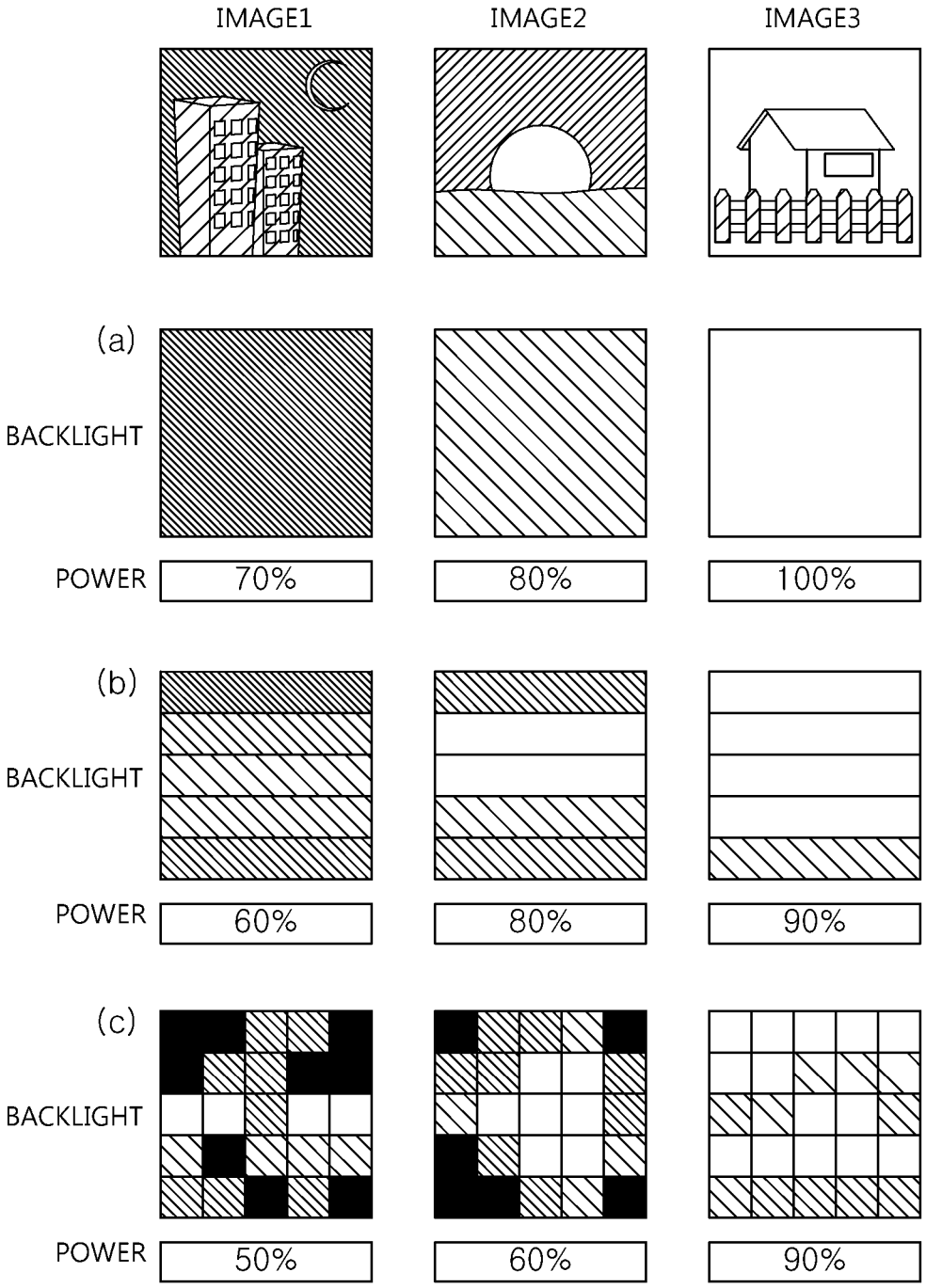
FIG. 3C is a schematic diagram illustrating an LCD according to one embodiment of the present disclosure.

FIG. 3C is a schematic diagram illustrating a liquid crystal display apparatus according to one embodiment of the present disclosure.

In (a), (b), and (c) of FIG. 3C, backlight brightness values corresponding to blocks (a), (b), and (c) are determined with respect to images 1, 2, and 3, and visually illustrated. The liquid crystal display apparatus according to one embodiment of the present disclosure may apply the paper mode and control the brightness of the backlight, and then additionally adjust the brightness of the backlight in (a), (b), and (c) of FIG. 3C.

Referring to (a) of FIG. 3C, the liquid crystal display apparatus may determine the brightness of the backlight by analyzing the images 1, 2, and 3, calculate a brightness reduction degree of the image to which the paper mode is applied, and convert the image based on the calculated brightness reduction degree. The liquid crystal display apparatus according to one embodiment of the present disclosure may obtain an additional power consumption reduction in accordance with dimming driving of (a) of FIG. 3C.

Referring to (b) and (c) of FIG. 3C, the liquid crystal display apparatus may determine the brightness of the backlight with respect to each block by analyzing the images 1, 2, and 3, calculate a brightness reduction degree of the image to which the paper mode is applied, and then convert the image based on the calculated brightness reduction degree.

The above-described conversion of the image may be used to compensate for the brightness reduction in accordance with the dimming driving for each block in the panel side different from the backlight side, and pixels within a single block may respectively display different gradation.

By determining the brightness of the backlight different for each block after applying the paper mode, converting the input image, and determining the brightness of the backlight, the liquid crystal display apparatus according to one embodiment of the present disclosure may enable additional power consumption reduction, and control C/R to improve visibility.

The backlight of the liquid crystal display apparatus for implementing (b) and (c) of FIG. 3C may be designed so that elements such as a lamp and the light of the backlight form a plurality of blocks, and the control unit of the backlight may be designed to transmit a control signal to each of the plurality of blocks so that each of the plurality of blocks may be controlled.

Figure 4:
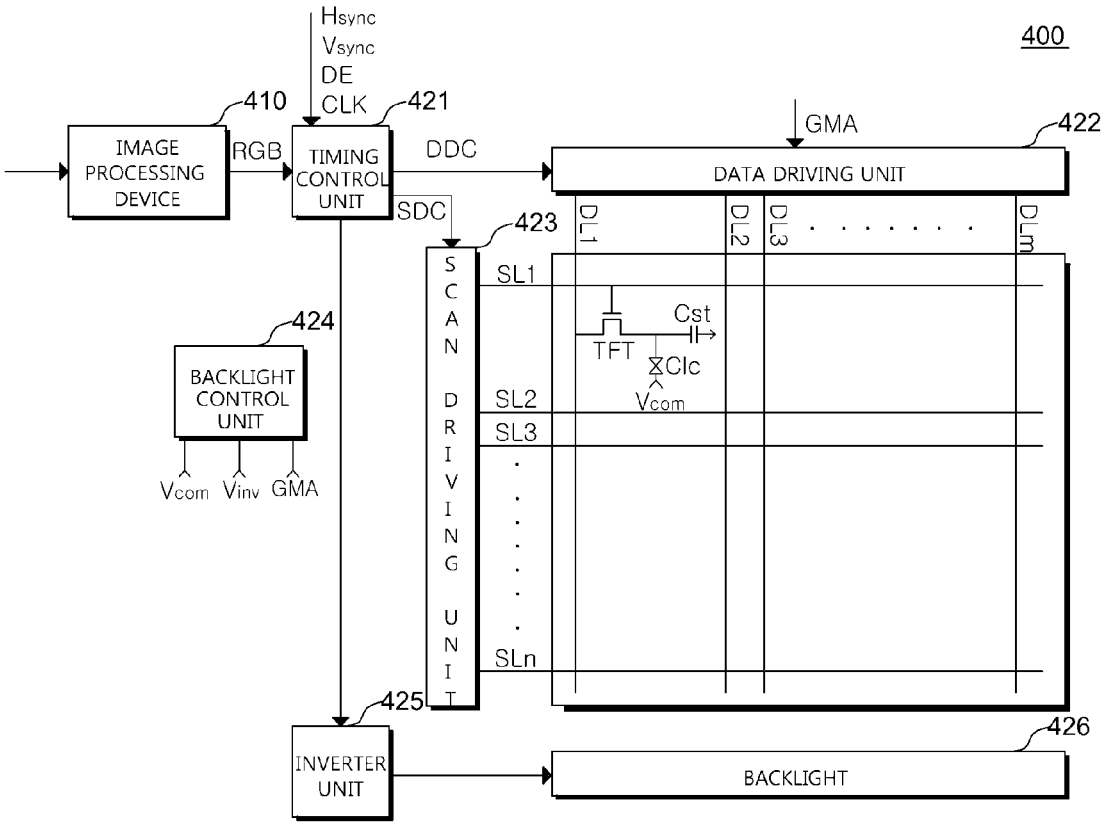
FIG. 4 is a conceptual diagram illustrating driving of an LCD according to one embodiment of the present disclosure.

FIG. 4 is a conceptual diagram illustrating driving of an LCD according to one embodiment of the present disclosure. The liquid crystal display apparatus 400 includes an image processing device 410, a timing control unit 421, a display panel, a data driving unit 422, and a scan driving unit 423.

The image processing device 410 may receive an input image, first convert the image so that the received image is operated in a selected screen mode, second convert the first converted image so that the converted image has a maximum gradation value, and determine brightness of the backlight of the display apparatus in response to the conversion for enabling the converted image. The determined brightness of the backlight and the converted input image may be transmitted to the timing control unit 421.

The timing control unit 421 may be referred to as a display driving unit, generate a source driver control (SDC) signal based on an image having adjusted image characteristics to control the scan driving unit 423, and generate a data driver control (DDC) signal to control the display data driving unit 422.

The input image may be converted into an analogue voltage through a digital to analogue converter (DAC), the converted input image may be input to a pixel electrode of the display apparatus 120, and then the input image may be displayed on the display apparatus 120.

Meanwhile, when the first converted image has the smaller gradation range, a range of the gradation input to DAC becomes smaller, and therefore a gradation representation capability of an analogue voltage that is an output of the DAC is reduced, resulting in a reduction in a gradation representation capability of an output image and a reduction in a color representation capability.

The data driving unit 422 may receive a DDC signal from the display timing control unit 421. The display data driving unit 422 may perform sampling on data in accordance with the DDC signal, latch the sampled data by each line for each horizontal interval, and then supply the latched data to data lines DL1, DL2, . . . , and DLm.

In addition, the received digital image signal is converted into an analogue image signal using a gamma voltage (GMA) to supply the converted signal to the data lines DL1, DL2, . . . , and DLm.

The scan driving unit 423 may be operated by driving a scan line so that a data signal is input to a sub pixel corresponding to each scan line. The gate driving unit may include a shift register for sequentially generating a scan pulse in response to the SDC signal from the timing control unit 421 and a level shifter for shifting a voltage of the scan pulse into a voltage level suitable for driving of a liquid crystal cell (clc).

The scan driving unit 423 may sequentially supply the scan voltage to scan lines SL1, SL2, . . . , SLn in response to the SDC signals.

The scan driving unit 423 may provide, to the display panel, a plurality of scan line signals for selecting at least one among the above-described scan lines SL1, SL2, . . . , and SLn.

The power supply unit 424 may supply a common electrode voltage (Vcom), supply a gamma voltage (GMA) to the data driving unit 422, and supply a BL driving voltage (Vbl) to the backlight control unit 425.

The power supply unit 424 may be formed in the form of a separate IC. The power supply unit 424 may further include a DC/DC converter for supplying a required voltage, and a PWM driving unit. The PWM driving unit may have a duty and adjust brightness with a corresponding duty.

The backlight control unit 425 may convert a DC or AC voltage into a voltage and a duty or a frequency suitable for being supplied to the backlight 426 in accordance with a type of the light source under control of the timing control unit 421.

The backlight control unit 425 may output a voltage of adjusting the brightness of the backlight 426 in accordance with a control voltage of the backlight 426 input from the timing control unit 421 in accordance with adjustment of the screen mode. The brightness may be adjusted by adjusting a PWM duty signal input from the timing control unit 421.

The backlight 426 includes a fluorescent lamp or an LED for irradiating the liquid crystal panel with light.

Figure 6:
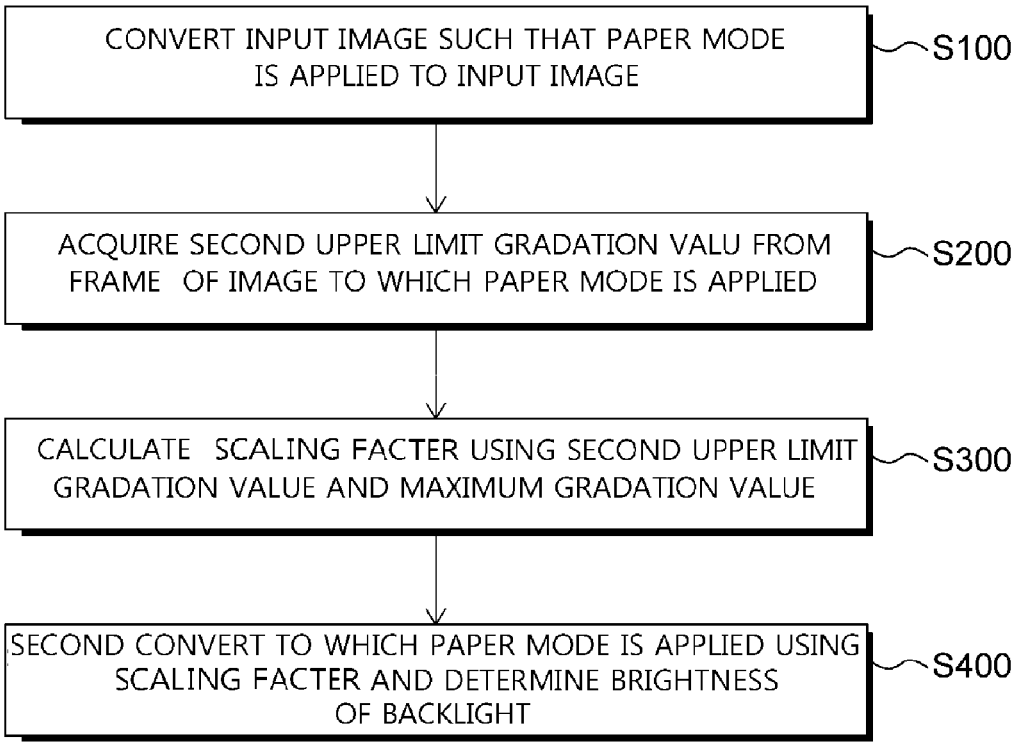
FIG. 6 is a flowchart illustrating a display method of an LCD according to one embodiment of the present disclosure.

The liquid crystal display panel includes a plurality of scan lines SL1, SL2, . . . , and SLn, a plurality of data lines DL1, DL2, . . . , and DLm, and a plurality of sub pixels. In FIG. 6, for convenience of description, a single sub pixel is illustrated and described. The scan lines SL1, SL2, . . . , and SLn extend in one direction, and the data lines DL1, DL2, . . . , and DLm extend in a direction intersecting the one direction, that is, a direction parallel to the one direction.

Each of the sub pixels includes a thin film transistor (TFT) connected to each of the data lines and each of the scan lines. In the liquid crystal display panel, a liquid crystal is injected between a lower substrate and a front substrate. On the lower substrate of the liquid crystal display panel, a storage capacitor (Cst) for maintaining a voltage of a liquid crystal cell (Clc) may be formed.

The scan driving unit 423 may be connected with one end of the scan lines SL1, SL2, . . . , and SLn or both ends thereof. The scan driving unit 423 may generate a plurality of scan signals using the SDC signals provided from the timing control unit 421 and gate on/off voltages provided from the voltage generation unit, and apply the scan signals to the scan lines SL1, SL2, . . . , and SLn which are arranged on the display panel.

The data driving unit 422 may be connected with one end of the data lines DL1, DL2, . . . , and DLm. The data driving unit 422 may receive data signals (RGB) and a gamma voltage (GMA) provided from the timing control unit 421. The data driving unit 422 may convert data signals into data voltages in the form of analogue signals based on the gamma voltage (GMA), and apply the converted signals to the data lines DL1, DL2, . . . , and DLm which are arranged on the display panel.

Consequently, the first converted image has the smaller gradation range than the input image. Therefore, the gradation representation capability of the first converted image and the color representation capability of the first converted image are reduced.

In one embodiment of the present disclosure, when the gradation range of the first converted image of red is 22nd to 250th, the gradation range of the first converted image of green is 30th to 240th and the gradation range of the first converted image of blue is 40th to 230th. Therefore, a total number of representable colors is (250−22)×(240−30)×(230-40), that is, 9,097,200 colors.

In one embodiment of the present disclosure, the image processing device is configured to solve the reduction in the gradation representation capability. The first converted image may have one or m digital-bit compare to the input image. In other words, the first converted image may have a value within the gradation range between 0th to (2n+m−1)th. Therefore the gradation representation capability of the output image can be maintained.

For example, when n is 8, the gradation range of the input image is 0th to 255th and when m is 1, the gradation range of the first converted image is 0th to 511th. In this example, the target minimum gradation value of the first converted image is 44 and the target maximum gradation value of the first converted image is 500 for realizing the image characteristics of the selected screen mode. Therefore, the gradation representation capability of the first converted image is maintained by adding at least one bit to the input image.

It should be noted that in this example, the maximum gradation value of the input image is 255th as the number of bit is 8. On the other hand, the new maximum gradation value of the first converted image is 511th as one bit is added to the input image.

In one embodiment of the present disclosure, the image characteristics of the paper mode are further adjusted based on the ambient conditions. This is because the actual paper may be exposed by ambient light. Therefore the image characteristics of the actual paper that users can experience under the ambient light may differ. Consequently, the paper mode may adaptively change the image characteristics in accordance with the ambient light for realizing a paper-like feeling under various ambient light conditions.

In one embodiment of the present disclosure, a list of paper mode is provided. For example, newsprint paper mode, copy-paper paper mode, and glossy-photo paper mode. The image characteristics of the paper mode for a paper-like feeling can be obtained through a simulation or a test. For example, the image characteristics of a creamy-vellum-paper can be determined by setting a test bed with a creamy-vellum-paper in which reflectivity of 80% and a whiteness index of 60.6% under a fluorescent lamp with a color temperature of 6500 k and 500 lux of illuminance. The test result of the image characteristics of a creamy-vellum-paper may has image characteristics such as a maximum brightness of 182 to 192 nits, a color temperature of 5560 to 5660 k, and a contrast ratio of 32:1. The result can be stored in the image processing device.

In this example, the image processing device is configured to receive the image characteristics of the creamy-vellum-paper mode. The maximum brightness of the display apparatus is about 300 to 400 nits. The paper mode conversion unit may convert the input image so as to have the maximum brightness similar to the image characteristics of the creamy-vellum-paper mode. The paper mode conversion unit may reduce the maximum brightness up to 40% to 50% to realize the image characteristics of the creamy-vellum-paper which has a maximum brightness of 182 to 192 nits.

In one embodiment of the present disclosure, the paper mode conversion unit may apply the paper mode to the input image after performing stretching of the gradation value by histogram analysis so that gradation aggregation of the input image may be minimized.

In one embodiment of the present disclosure, the paper mode conversion unit may detect the second upper limit gradation value in an input image. The paper mode conversion unit converts the upper limit gradation value into the maximum gradation value. The paper mode conversion unit calculates the scaling factor for the upper limit gradation value and the maximum gradation value. The paper mode conversion unit multiplies the scaling factor for the reaming pixels of the input image.

In one embodiment of the present disclosure, the scaling factor calculating unit may multiply a weighted value by the scaling factor. The weighted value applied to the scaling factor may be, for example, a user input or a value determined from sensors for obtaining ambient light conditions. The weighted value applied to the scaling factor may be referred to as a dimming ratio.

When the gradation values of red, green and blue pixels of the first converted image is multiplied by the scaling factor, it is predicted that some part of the red, green and blue are saturated in terms of the gradation value when the multiplied gradation value is exceeding the maximum gradation value.

When multiplying each gradation value of the first converted image by the scaling factor, the multiplied red, green and blue values may exceed the maximum gradation value, and a part of the multiplied red, green and blue colors values may be saturated in the maximum gradation value.

$$\text{Weighted Scaling factor} = \frac{\text{maximum gradation value}}{\text{second upper limit gradation value}} \times (\text{weighted value})$$

In this case, the scaling factor calculating unit may apply the weighted value to the scaling factor so that saturation of the gradation may be prevented.

In one embodiment of the present disclosure, a method of calculating the scaling factor and correcting the first converted image by multiplying the each gradation value by the scaling factor may be a method of performing histogram stretching by analyzing a histogram.

The gradation value scaling unit may create a histogram of the first converted image and convert the second upper limit gradation value in the histogram to into the maximum gradation value, and convert the remaining gradation values in the same proportion. The histogram data is created in such a manner that a number of bins in which there is input image is divided by 2n, for example, brightness intervals, and the frequency of appearance of data included in each interval is detected. An x-axis of the histogram indicates the gradation value of the first converted image from 0th to 255th in case of 8-bit input image. A y-axis indicates the frequency of gradation values of the first converted image.

In one embodiment of the present disclosure, the gradation value scaling unit may apply offset to the maximum gradation value after applying the scaling factor to the maximum gradation value so that a saturation and a gradation aggregation in the maximum gradation value can be reduced, and the gradation value of a predetermined region may be corrected using the scaling factor to which the weighted value is applied.

Figure 5:
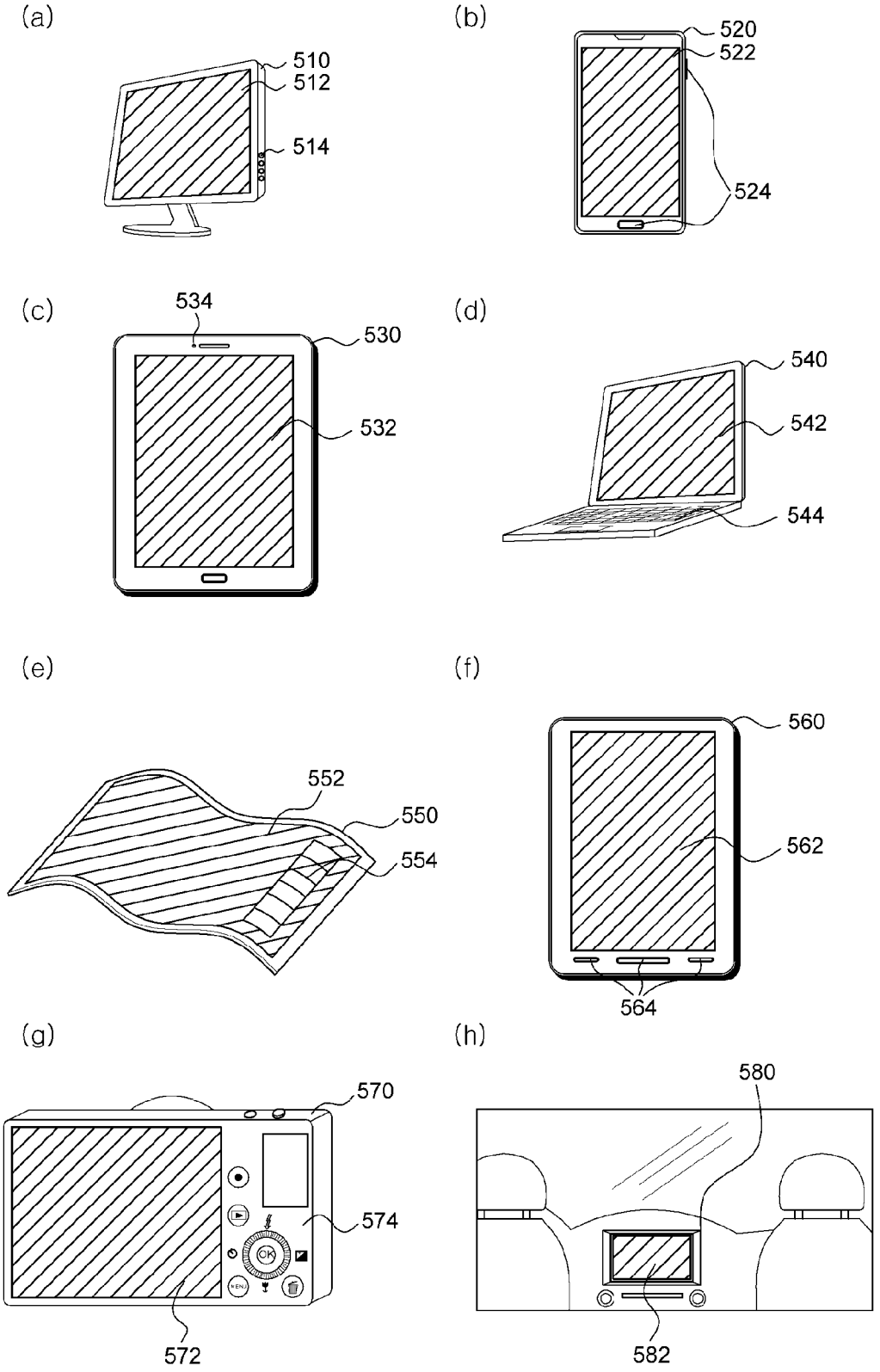
FIG. 5 is a schematic diagram illustrating devices to which a display apparatus according to one embodiment of the present disclosure is applied.

FIG. 5 is schematic diagrams illustrating a plurality of devices to which a display device according to one exemplary embodiment of the present disclosure can be applied.

A portion (a) of FIG. 5 illustrates a case in which a display apparatus according to various embodiments of the present disclosure is used as a display device 510.

A portion (b) of FIG. 5 illustrates a case in which a display apparatus 522 according to various embodiments of the present disclosure is a mobile communication device 520.

A portion (c) of FIG. 5 illustrates a case in which a display apparatus 532 according to various embodiments of the present disclosure is used as a tablet PC 530.

A portion (d) of FIG. 5 illustrates a case in which a display apparatus 542 according to various embodiments of the present disclosure is used as a notebook computer 540.

A portion (e) of FIG. 5 illustrates a case in which a display apparatus 552 according to various embodiments of the present disclosure is used as a flexible display device 550.

A portion (f) of FIG. 5 illustrates a case in which a display apparatus 562 according to various embodiments of the present disclosure is used as an e-book device 560.

A portion (g) of FIG. 5 illustrates a case in which a display apparatus 572 according to various embodiments of the present disclosure is used as a digital camera 570.

A portion (h) of FIG. 5 illustrates a case in which a display apparatus 582 according to various embodiments of the present disclosure is used as a navigation device 580 for vehicles.

FIG. 6 is a flowchart illustrating a display method of an LCD according to one embodiment of the present disclosure.

Hereinafter, for convenience of description, description will be made with reference to the second upper limit gradation value calculating unit, the scaling factor calculating unit, the image conversion unit, and the backlight brightness determining unit of FIG. 3B. In addition, all steps may be performed independently, but may be described as a single process in the following description, for convenience of description.

First, in step S100, an input image is first converted so that a paper mode is applied to the input image. As a method of first converting the input image so that the paper mode is applied to the input image, a method using a lookup table and a method using an equation may be used. The method using the lookup table and the method using the equations are substantially the same as those described in FIGS. 2B and 2C, and thus repeated description thereof will be omitted.

In step S200, the second upper limit gradation value calculating unit acquires the highest gradation value from the first converted image as a second upper limit gradation value. The second upper limit gradation value calculating unit may acquire a histogram of the image to which the paper mode is applied, and acquire the second upper limit gradation value from the first converted image by analyzing the histogram. The second upper limit gradation value calculating unit may acquire the second upper limit gradation value from the histogram using a limited error rate.

In step S300, the scaling factor calculating unit calculates a scaling factor by dividing a maximum gray level representation value by the second upper limit gradation level value. The scaling factor calculating unit outputs the calculated scaling factor to the image conversion unit and the backlight brightness determining unit.

In step S400, the image conversion unit second converts the image to which the paper mode is applied by multiplying all values of the first converted image by the calculated scaling factor. The image conversion unit outputs the converted image to the LCD panel.

In addition, in step S400, the backlight control unit determines brightness of the backlight by dividing brightness of the backlight selected or set by a user by the calculated scaling factor. The backlight control unit outputs the determined brightness of the backlight to the backlight control unit.

In the driving method of the liquid crystal display apparatus according to one embodiment of the present disclosure, step S100 in which the input image is converted so that the paper mode is applied to the input image may precede step S400 in which the input image to which the paper mode is applied is converted by multiplying all gradation values of the first converted image by the calculated scaling factor.

A combination of blocks in an accompanying block diagram and a combination of operations in a flowchart may be performed by algorithms or computer program instructions which are composed of a firmware, software, or hardware. The instructions used to execute the computers or the other programmable data processing equipment can provide operations for executing the functions described in each of the blocks in the block diagram or each of the operations in the flowchart.

Operations of the methods or algorithm described in connection with the exemplary embodiments disclosed in this specification may be directly implemented using a hardware module, a software module, or a combination thereof executed by a processor. The software module may be permanently installed on a RAM memory, flash memory, ROM memory, EPROM memory, EEPROM memory, register, hard disk, detachable disk, CD-ROM, or any other types of storage media known in the related art. An exemplary storage medium may be coupled to a processor, so that the processor can read information from a storage medium and write information in a storage medium. For an alternative example, a storage medium may be formed integrally with a processor. In this case, the processor and the storage medium may be permanently mounted in an application-specific integrated circuit (ASIC). The ASIC may be permanently mounted in a user terminal. For an alternative example, the processor and the storage medium may be permanently mounted as separate components in a user terminal.

It will be apparent to those skilled in the art that various modifications can be made to the above-described exemplary embodiments of the present disclosure without departing from the spirit or scope of the disclosure. Thus, it is intended that the present disclosure covers all such modifications provided they come within the scope of the appended claims and their equivalents.

What is claimed is:

1. A display controlling apparatus that is driven in a paper mode and includes a backlight, the display controlling apparatus comprising:

an image processing device first converting a gradation value of an input image so as to have image characteristics of the paper mode, and second converting the first converted gradation value of the input image so as to have a maximum gradation value; and a backlight brightness determining unit determining brightness of light irradiated by the backlight to be lowered in response to the second conversion of the gradation value.

2. The display controlling apparatus of claim 1, wherein the image processing device first converts the gradation value of the input image by associating the gradation value of the input image with a lookup table.

3. The display controlling apparatus of claim 1, wherein the first conversion of the gradation value of the input image includes applying a first upper limit gradation value and a first lower limit gradation value of the paper mode.

4. The display controlling apparatus of claim 1, wherein, in the image processing device the second conversion of the gradation value is performed by applying a scaling factor to the first converted gradation value of the input image.

5. The display controlling apparatus of claim 4, wherein the scaling factor is a ratio of a second upper limit gradation value acquired from the first converted image and the maximum gradation value, and wherein the second upper limit gradation value is the highest gradation value in the first converted image.

6. The display controlling apparatus of claim 4, wherein the backlight brightness determining unit determines to lower the brightness of the backlight by applying the scaling factor to the brightness of the backlight for the input image.

7. The display controlling apparatus of claim 5, wherein the backlight brightness determining unit determines to lower the brightness of the backlight by applying the scaling factor to the brightness of the backlight for the input image.

8. The display controlling apparatus of claim 1, wherein the image characteristics of the paper mode include at least one of a color temperature, brightness, and a contrast ratio.

9. The display controlling apparatus of claim 1, wherein the gradation value of the input image includes a gradation value of each of R, G, and B colors, and the first conversion for the gradation value of the input image and the second conversion for the first converted gradation value of the image are associated with each of gradation values of the R, G, and B colors.

10. The display controlling apparatus of claim 1, wherein the image characteristics of the paper mode are image characteristics with respect to a plurality of different types of papers.

11. The display controlling apparatus of claim 1, wherein the second conversion of the image processing device is implemented by histogram stretching.

12. The display controlling apparatus of claim 11, wherein the backlight brightness determining unit determines the brightness of the backlight to be lowered in accordance with a degree to which the histogram stretching is performed.

13. An electronic device comprising:

a liquid crystal display panel displaying an image having image characteristics of a paper mode and a maximum gradation value;

a backlight irradiating the liquid crystal display panel with light;

an image processing device converting a gradation value of an input image to have the image characteristics of the paper mode and the maximum gradation value; and a backlight control unit controlling brightness of light irradiated by the backlight to be lowered in response to the gradation conversion of the input image to have the maximum gradation value.

14. A method for displaying an image in a display apparatus including a backlight, the method comprising:

first converting a gradation value of an input image to have image characteristics of a paper mode;

second converting the first converted gradation value of the image to have a maximum gradation value;

controlling brightness of the backlight in response to the second conversion; and displaying an image of the second converted gradation value.

15. The method of claim 14, wherein the first converting comprises associating the gradation value of the input image with a lookup table.

16. The method of claim 14, wherein the converting the gradation value of the input image to have the image characteristics of the paper mode includes applying a first upper limit gradation value and a first lower limit gradation value to the input image.

17. The method of claim 14, wherein the second converting comprises applying a scaling factor to the first converted gradation value of the image.

18. The method of claim 17, wherein the scaling factor is a ratio of a second upper limit gradation value of the first converted image and the maximum gradation value, and wherein the second upper limit gradation value is the highest gradation value in the first converted image.

19. The method of claim 17, wherein the controlling of the brightness of the backlight comprises lowering the brightness of the backlight by applying the scaling factor to the brightness of the backlight with respect to the input image.

20. The method of claim 18, wherein the controlling of the brightness of the backlight comprises lowering the brightness of the backlight by applying the scaling factor to the brightness of the backlight with respect to the input image.

21. The method of claim 14, wherein the gradation value of the input image includes a gradation value of each of R, G, and B colors, and the first converting and the second converting are associated with each of gradation values of the R, G, and B colors.

* * * * *